US005346110A

United States Patent [19]

Petrou

[11] Patent Number: 5,346,110

[45] Date of Patent: Sep. 13, 1994

[54] GARMENT HANGER WITH PIVOTABLE ARMS

[76] Inventor: Nicolean Petrou, 1531 W. Tadmar Ave., Anaheim, Calif. 92802

[21] Appl. No.: 65,973

[22] Filed: May 21, 1993

[51] Int. Cl.[5] ..... A47G 25/48; A47G 25/50

[52] U.S. Cl. ..... 223/89; 223/94; 223/96; 223/85

[58] Field of Search ..... 223/85, 88, 92, 94, 223/89; 211/113; D6/315

[56] References Cited

U.S. PATENT DOCUMENTS

| | | | |
|---|---|---|---|
| D. 32,688 | 5/1900 | Heimann . | |
| D. 161,401 | 12/1950 | Wurtz . | |
| D. 259,979 | 7/1981 | Hazenveld . | |
| 2,411,466 | 11/1946 | Robey . | |
| 2,557,854 | 12/1951 | Marbit | 223/94 |
| 2,828,897 | 4/1958 | Gordon . | |
| 2,908,430 | 10/1959 | Deranja et al. . | |
| 3,317,096 | 5/1967 | Bissonnette et al. . | |
| 3,531,028 | 9/1970 | Vazquez | 223/94 |
| 3,792,776 | 2/1974 | Kenison | 223/89 |
| 4,223,817 | 9/1980 | Hazenveld . | |
| 4,227,632 | 10/1980 | Collis | 223/94 |
| 4,600,132 | 7/1986 | Blanchard . | |
| 4,618,080 | 10/1986 | Shalson . | |
| 4,673,116 | 6/1987 | Keller | 223/94 |
| 4,813,581 | 3/1989 | LaMont | 223/94 |
| 4,923,102 | 5/1990 | Agathangelou . | |
| 4,948,019 | 8/1990 | Rodum | 223/94 |
| 5,044,534 | 9/1991 | Hwang | 223/94 |
| 5,046,649 | 9/1991 | Hazenveld . | |
| 5,085,358 | 2/1992 | Lam | 223/94 |

*Primary Examiner*—Clifford D. Crowder
*Assistant Examiner*—Bibmu Mohanty
*Attorney, Agent, or Firm*—Stroock & Stroock & Lavan

[57] ABSTRACT

A one-piece garment hanger formed from a plastic material includes an elongated hanger body integrally molded from a plastic material having first and second opposing ends. A first arm is integrally formed to the first end of the hanger and a second arm is integrally formed to the second end of the hanger. The first and second arms extend downwardly and outwardly from the hanger body at an acute angle with respect thereto. Integrally formed essentially semi-circular biasing webs biasingly couple the first and second arms to the garment hanger body. The first and second arms are manually forcible against the opposing spring action provided by the biasing webs to releasably capture a garment therebetween.

15 Claims, 4 Drawing Sheets

GARMENT HANGER WITH PIVOTABLE ARMS

BACKGROUND OF THE INVENTION

The present invention is directed generally to a garment hanger used to hang garments by the waistband thereof and, in particular, to a one-piece plastic molded garment hanger which includes arms integrally pivotably joined to the ends of the hanger body.

In the past there have been various proposals for garment hangers used to hang garments by the waistband thereof. One such proposal is found in the 1958 patent to Gordon, U.S. Pat. No. 2,828,897 which discloses a multi-component hanger with opposing arms which are biased outwardly by means of a separate coil spring. Not only are such hangers difficult and expensive to manufacture, but the components tend to break after extended use.

Another type of hanger used to hang garments by the waistband involves the use of fingers depending downwardly from the hanger body in which the waistband of the garment is captured. Such garment hangers have proven successful, but the fingers tend to creep thereby releasing the garment, and a major portion of the garment hanger is exposed during use.

Another form of garment hanger used to hang garments by the waistband involves the use of clamps on the garment hanger body which are releasably held together by a separate sliding metal spring clip. Such garment hangers involving the use of separate components are difficult and expensive to manufacture and while useful, have proven less than completely satisfactory.

Accordingly, it would be desirable to provide a one-piece all plastic garment hanger used to hang garments from the waistband thereof which has built-in gripping spring action and wherein the garment hanger body is essentially covered by the hanging garment.

SUMMARY OF THE INVENTION

Generally speaking, in accordance with the present invention, a one-piece plastic garment hanger for hanging garments by the waistband thereof is provided. The garment hanger includes an elongated hanger body integrally molded from a plastic material, with the hanger body having first and second opposing ends. A first arm is integrally formed to the first end of the hanger body and a second arm is integrally formed to the second end of the hanger body. The first and second arms extend downwardly and outwardly from the hanger body and form an acute angle with respect to the hanger body. Integrally formed essentially semi-circular biasing webs join the first and second arms to the body. The first and second arms are manually forcible against the opposing spring action provided by the semi-circular webs to releasably capture the waistband of the garment therebetween.

In a preferred embodiment, the garment hanger is formed from a polycarbonate material and includes downwardly facing hooks on the semi-circular webs to prevent the garment from riding up on the garment hanger.

In a most preferred form of the present invention, separate pivotable fingers are integrally formed on the outer ends of the arms and are likewise integrally formed through essentially semi-circular webs thereto. The ends of the fingers each include a hook portion which prevents the garment from riding up on the garment hanger.

Accordingly, it is an object of the present invention to provide an improved garment hanger with pivotable arms for holding a garment by the waistband thereof.

Another object of the present invention is to provide a one-piece integrally formed plastic garment hanger which provides the necessary built-in spring force to hold a garment by the waistband thereof.

A further object of the present invention is to provide a one-piece plastic garment hanger with integrally formed pivotable arms and fingers which is constructed to prevent breakage thereof during use.

A still further object of the present invention is to provide a one-piece plastic garment hanger with opposing integrally formed spring biased arms wherein the bending forces are distributed over a large area to provide extensive movement, to minimize breakage and to provide a more uniform spring force.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
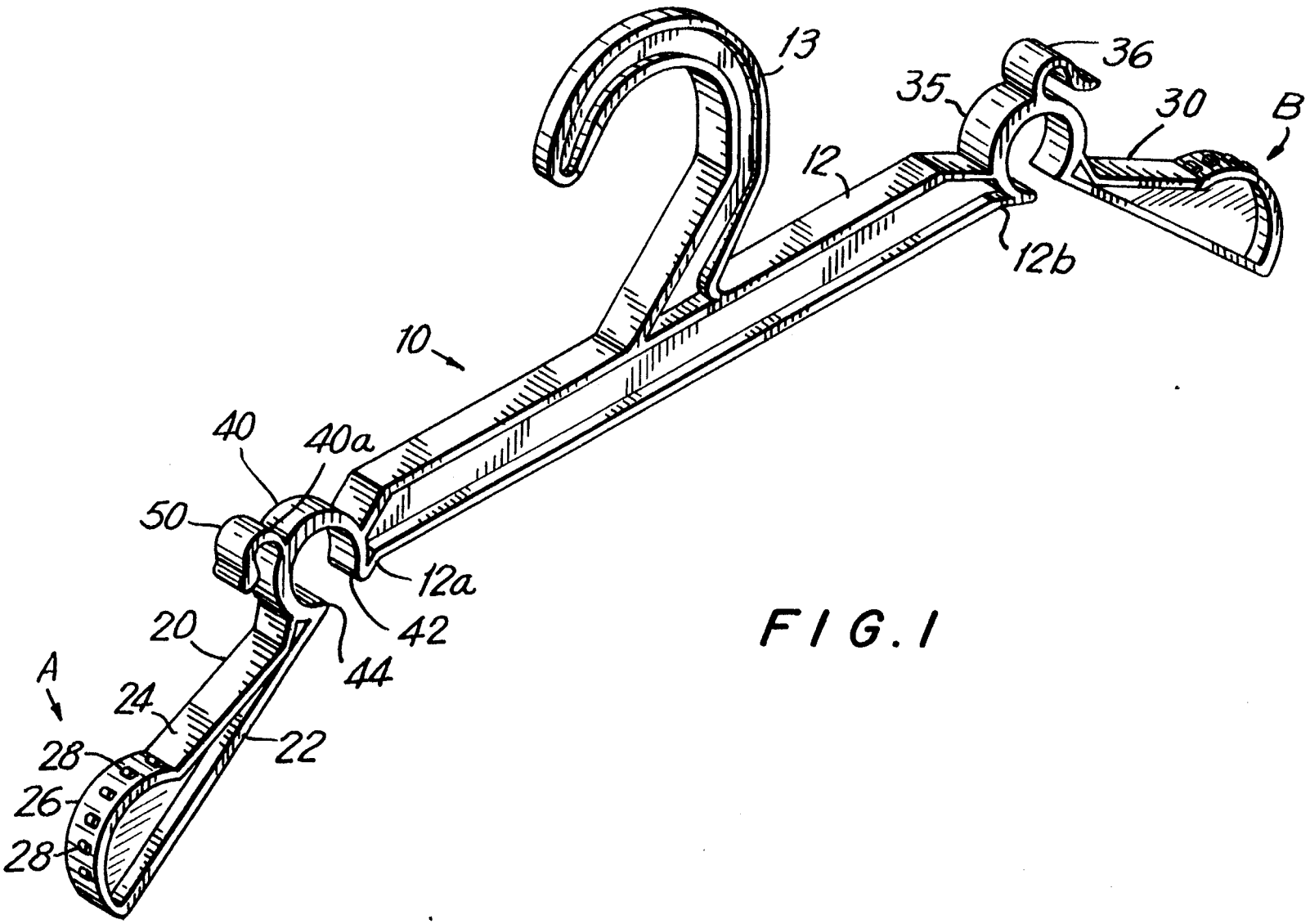
FIG. 1 is a perspective view of a garment hanger constructed in accordance with a first embodiment of the present invention.

Reference is first made to FIG. 1 which depicts a garment hanger, generally indicated at 10, and constructed in accordance with a first embodiment of the present invention. Garment hanger 10 includes an elongated garment hanger body 12 having a hook 13 extending upwardly essentially from a central portion thereof. Hook 13 is used to suspend garment hanger 10 from a rod or the like.

Garment hanger body 12 includes a first end **12*a* and a second end 12*b* to which are respectively coupled a first arm 20 and a second arm 30 as described below in detail. Arms 20 and 30 extend outwardly and downwardly from garment hanger body 12 so as to each form an acute angle with respect thereto. In the present embodiment, the angle is about 45°. Since the construction, use and coupling of first arm 20 and second arm 30 are the same, only the features of first arm 20** will be described in detail hereinafter.

First arm 20, like garment hanger body 12, is formed of an I-beam construction and includes a flat back wall 22 having a front wall 24 extending outwardly at an angle with respect thereto. A rounded bulbous portion 26 is formed at the end of front wall 24 and includes a plurality of projections 28 thereon which assist in gripping the garment as will further be described below.

An essentially semi-circular biasing web 40 joins arm 20 to first end 12*a* of garment hanger body 12. Web 40 is formed from the same plastic material as the rest of the garment hanger body and is solid in form as depicted. Due to the shape and configuration thereof, web 40 will act like a spring to exert a torque to normally position and bias arm 20 in the position depicted in FIG. 1. Web 40 includes a first end 42 formed at first end 12*a* of garment hanger body 12 and a second end 44 formed at the end of first hanger arm 20. A downwardly open hook 50 is formed on the outer surface 40*a* of web 40.

Second arm 30 is likewise joined to second end 12*b* of garment hanger body 12 through an essentially semi-circular web 35 having a downwardly opening hook 36 integrally formed thereon.

The resiliency of web 40 will tend to cause arm 20 to rotate so as to tend to return to the position depicted in FIG. 1 as it is pressed downwardly and inwardly in the direction of arrow A. The same biasing effect will be provided when second arm 30 is pressed downwardly and inwardly in the direction of arrow B due to the resiliency of web 35.

Figure 3:
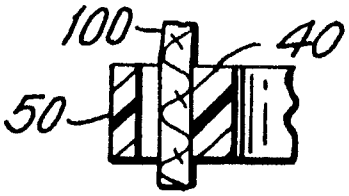
FIG. 3 is a sectional view taken along line 3—3 of FIG. 2.
Figure 2:
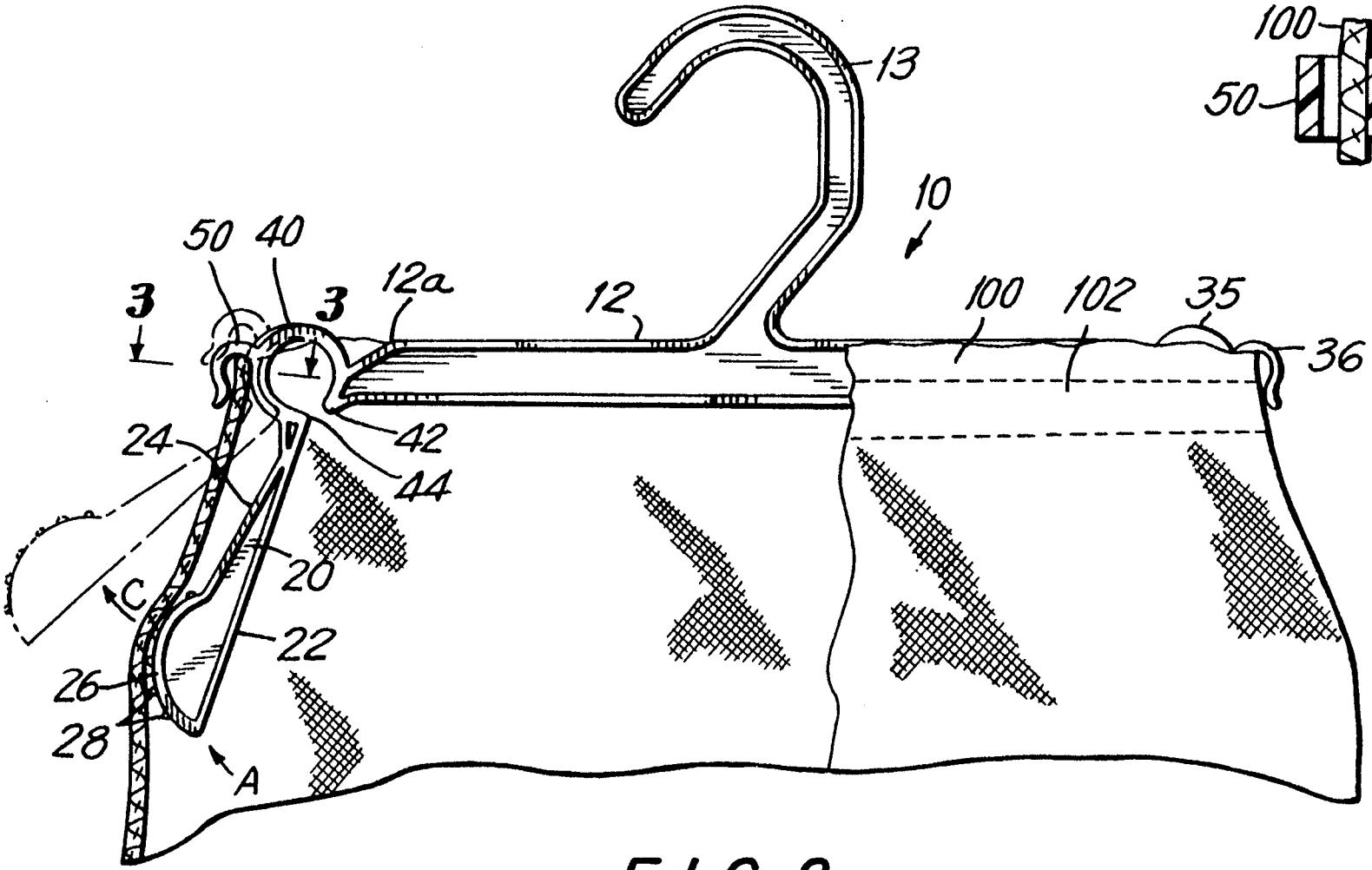
FIG. 2 is a front elevational view of the garment hanger in FIG. 1 with a garment shown hanging thereon by the waistband thereof, the view being partially cut away to show the action of one arm during use.

Referring now to FIGS. 2 and 3 in addition to FIG. 1, a garment 100 is shown hanging on garment hanger 10. In order to hang a garment on such hanger, arms 20 and 30 are manually pressed downwardly and inwardly towards one another in the respective directions of arrows A and B whereafter they may be inserted in the waistband 102 of garment 100.

It is noted that opposing ends 42 and 44 of web 40 will meet to prevent further inward movement of arm 20 when arm 20 is essentially perpendicular to garment hanger body 12. This will act to prevent excessive bending and stretching of web 12 to avoid breakage thereof.

After arms 20 and 30 are inserted in the waistband 102 of garment 100 and are released, the spring torque action of web 40 will force arms 20 and 30 to rotate outwardly and upwardly such as shown by arrow C in FIG. 2 with respect to arm 20. Such action by both arms 20 and 30 will securely hold garment 100 on the garment hanger by capturing waistband 102 therebetween. Hooks 50 and 36 prevent upward movement of waistband 102, which if not otherwise present would permit the garment to ride up above garment hanger 10. Hooks 50 and 35 are formed in an appropriate position on their respective webs such that when garment 100 is hanging on garment hanger 10, the waistband of the garment essentially covers the entire garment hanger save for hook 13 giving a neat appearance to any display in which the present garment hangers are utilized.

The semi-circular construction of webs 40 and 35 permit the webs to act as polymer springs where the bending forces are distributed over a large area to result in substantial movement before any breakage can occur and more uniform spring forces throughout the bending area. The mutually opposed spring action of arms 20 and 30 provide a balanced bending latitude to permit appropriate and regular holding of the garment through the waistband thereof.

The bulbous portions at the end of each of arms 20 and 30 act to better hold the garment in conjunction with the plurality of projections 28 thereon as best depicted in FIG. 2. However, it may be appreciated that the bulbous portions with projections may tend to provide bulges in the garment during display. Accordingly, the present inventor has developed a preferred embodiment which includes fingers formed on the respective opposing arms which will now be described in detail with reference to FIGS. 4 and 5.

Figure 4:
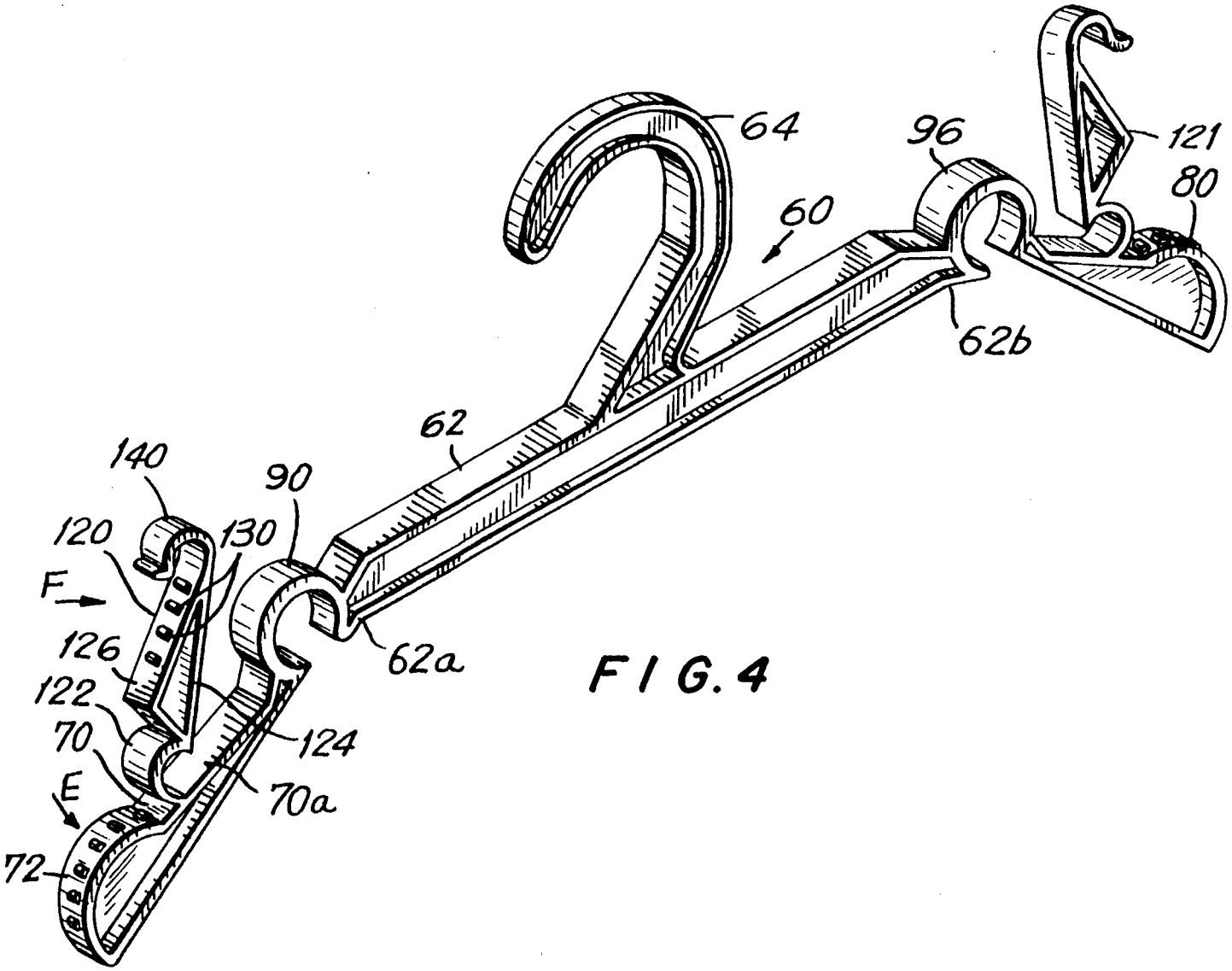
FIG. 4 is a perspective view of a garment hanger constructed in accordance with the present preferred embodiment of the present invention.

Referring to FIG. 4, a garment hanger 60 is depicted. Garment hanger 60 includes a garment hanger body 62 in elongated form similar to garment hanger body 12 in FIG. 1 and an upwardly extending hook 64 which is used to suspend the garment hanger from an appropriate rod or the like. Garment hanger body 62 includes opposing ends 62*a* and 62*b*. Opposing arms 70 and 80 extend outwardly and downwardly from respective ends 62*a* and 62*b* as depicted to form an acute angle with respect to garment hanger body 62. Semi-circular webs 90 and 96 biasingly couple arms 70 and 80, respectively, to the garment hanger body.

It is noted that rather than providing downwardly facing hooks 50 and 36 on the spring web members, separate upstanding fingers 120 and 140 are provided respectively on arms 70 and 80. Since arms 70 and 80 and fingers 120 and 140 are constructed in similar fashion, only the details with respect to arm 70 and finger 120 will be described.

Arm 70 and web 90 operate in the same manner as described above in detail with respect to the first embodiment of FIGS. 1 through 3. Web 90 will exert an outward and upward force on arm 70 when arm 70 is moved downwardly and inwardly in the direction of arrow E. Finger 120 is joined to the front surface 70*a* of arm 20 just above bulbous portion 72 through a semi-circular web 122. Finger 120 includes a flat back surface 124 and a front surface 126 angled with respect thereto having a plurality of projections 130 thereon. A downwardly opening hook 140 is formed at the free end of finger 120. Finger 120 can be moved inwardly in the direction of arrow F and if pressed too far will contact web 90 to prevent overbending.

Webs 90 and 122 provide the necessary spring action biasing force to properly hold a garment between arms 70 and 80.

Figure 5:
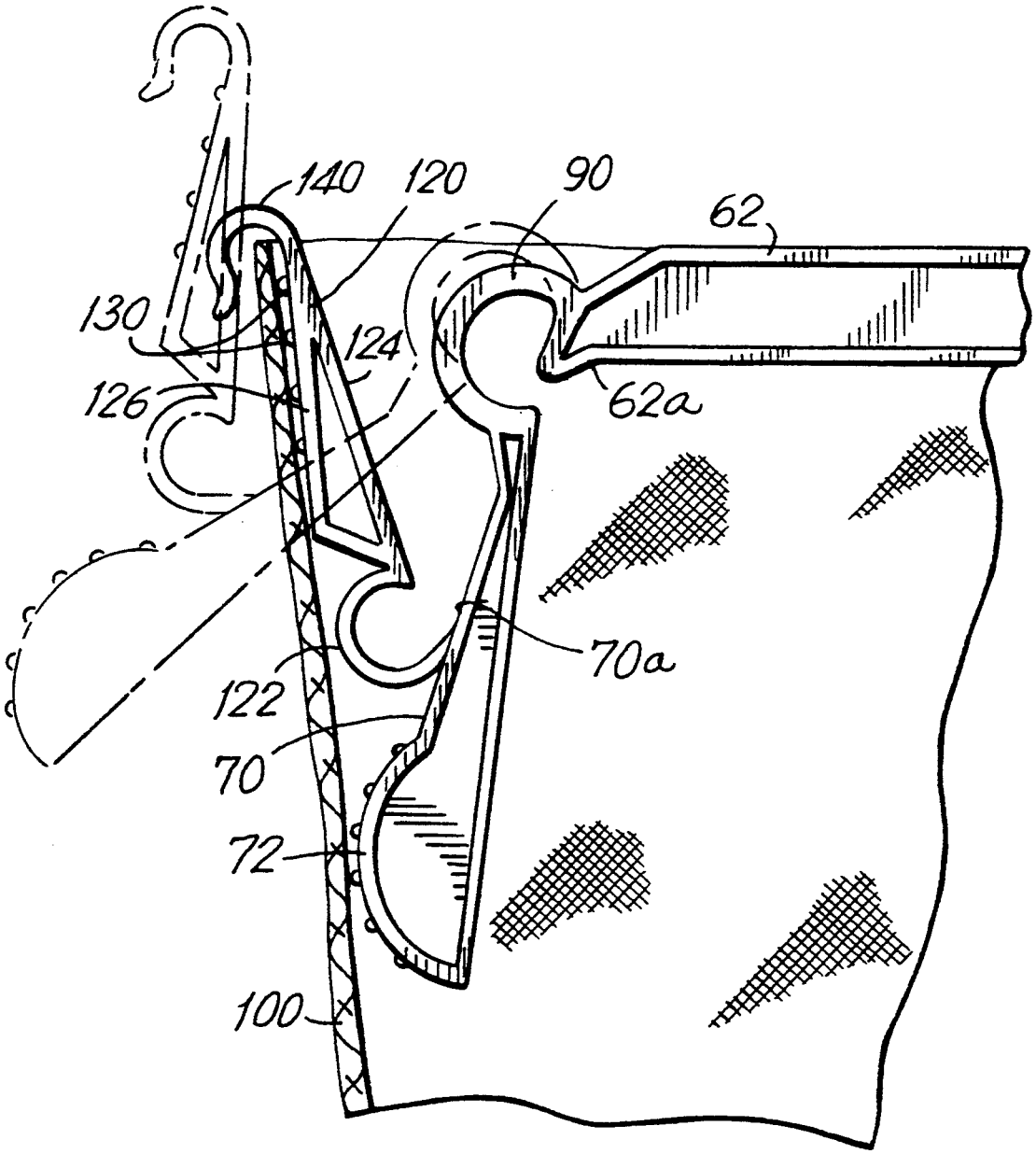
FIG. 5 is a partial front elevational view similar to FIG. 2 showing the action of one arm and finger of the garment hanger depicted in FIG. 4 used in connection with a garment.

Referring specifically to FIG. 5, a garment 100 is shown hanging on garment hanger 60. Arm 70 is shown biased inwardly. Web 90 exerts a torque on arm 70 causing it to tend to rotate back to its unbiased position shown in phantom in FIG. 5 thereby exerting an outward force on the garment. At the same time, finger 120 is forced inwardly towards arm 70 such that it presses outwardly against the upper portion of the waistband of the garment against the torque exerted by web 122.

Front portion 126 of finger 120 will provide a flat surface against which the waistband of garment 100 can rest. Garment 100 is held by the opposing spring tension of arms 70 and 80 within the garment itself thereby stretching the garment in a flat plane so as to present the garment in its best light without bulges. The dual spring action of the opposing arms and fingers permits accommodation of numerous garment sizes. Thus, one hanger size can be used for a wide range of garment sizes.

Hook 140 will prevent the waistband of garment 100 from riding up therebeyond. The garment will cover the entire hanger body save for the tip end of hook 140 and hook 64.

The second preferred embodiment provides two independent embodied springs on each arm that present parallel surfaces to the inside of the garment at the point of contact with the garment. As the arms move inwardly, the fingers move inwardly to provide a counterbalance of movement that results in the garment being held with parallel sides.

While the preferred material used to integrally form both embodiments of the invention is polycarbonate, it is recognized that other types of plastic material such as polypropylene could be utilized to manufacture the garment hangers to achieve the desired spring action. The cost of manufacture is also a factor which may result in a particular choice of plastic material. From a functional point of view, polycarbonate has so far proved to be the best material.

The present invention provides integrally formed one-piece garment hangers with pivotable arms which readily hold the waistband of a garment therebetween. The entire garment hanger is essentially covered by the garment hanging thereon. The garment hangers being integrally formed are relatively inexpensive to manufacture and yet achieve each of the advantages, benefits and objects as desired.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A one-piece garment hanger comprising an elongated hanger body integrally molded from a plastic material, said hanger body having first and second opposing ends, a first arm integrally formed to said first end of said hanger body and a second arm integrally formed to said second end of said hanger body, said first and second arms extending downwardly and outwardly from said hanger body at an acute angle with respect thereto, an integrally formed essentially semi-circular biasing means biasingly coupling said first and second arms to said hanger body tending to urge said first and second arms away from one another, said first and second arms being manually forcible towards one another against the opposing spring action provided by said biasing means to releasably capture a garment therebetween.

2. The garment hanger as claimed in claim 1, wherein said essentially semi-circular biasing means include first and second semi-circular solid webs formed integrally with said garment hanger body and said first and second arms, respectively, said webs providing an outward and upward force to said first and second arms when said first and second arms are moved towards one another.

3. The garment hanger as claimed in claim 1, wherein said essentially semi-circular biasing means include first and second semi-circular solid webs formed integrally with said garment hanger body and said first and second arms, said webs providing a torque tending to rotate said first and second arms away from one another.

4. A one-piece garment hanger comprising an elongated hanger body integrally molded from a plastic material, said hanger body having first and second opposing ends, a first arm integrally formed to said first end of said hanger body and a second arm integrally formed to said second end of said hanger body, said first and second arms extending downwardly and outwardly from said hanger body at an acute angle with respect thereto, an integrally formed essentially semi-circular biasing means biasingly coupling said first and second arms to said hanger body, said first and second arms being manually forcible against the opposing spring action provided by said biasing means to releasably capture a garment therebetween, a hook being formed on each of said first and second semi-circular biasing means which acts to prevent a garment from moving up on the garment hanger body.

5. The garment hanger as claimed in claim 1, wherein each of said first and second arms include an outer surface, a first finger extending upwardly from said outer surface of said first arm and a second finger extending upwardly from the outer surface of said second arm, said first and second fingers being biasingly coupled to said respective first and second arms.

6. The garment hanger as claimed in claim 5, further comprising a first essentially semi-circular web for biasingly coupling said first finger to said first arm, and a second essentially semi-circular web for biasingly coupling said second finger to said second arm.

7. The garment hanger as claimed in claim 6, wherein both of said fingers have free ends, the free ends of said fingers forming downwardly opening hooks which act to prevent the garment from moving up on the garment hanger body.

8. The garment hanger as claimed in claim 1, wherein said garment hanger is integrally formed from a polycarbonate material.

9. The garment hanger as claimed in claim 7, wherein said garment hanger is integrally formed from a polycarbonate material.

10. The garment hanger as claimed in claim 1, wherein said first and second arms include enlarged portions at the free ends thereof.

11. The garment hanger as claimed in claim 10, wherein said bulbous portions include a plurality of projections thereon.

12. The garment hanger as claimed in claim 3, wherein said first and second webs each include respective free ends which contact respectively when said arms are respectively moved to a position essentially perpendicular to said body.

13. A garment hanger comprising an elongated hanger body having first and second opposing ends, a first arm coupled to said first end of said hanger body and a second arm coupled to said second end of said hanger body, a first essentially semi-circular plastic web integrally joining said first arm to said first end of said garment hanger body and a second essentially semi-circular web integrally joining said second arm to said second end of said garment hanger body, said first and second webs exerting torque on said first and second arms tending to urge said arms apart as said arms are manually moved towards one another, said first and second arms including outer surfaces, an upwardly extending first finger on the outer surface of said first arm and an upwardly extending second finger on the outer surface of said second arm, said first and second fingers being respectively biasingly coupled to said respective arms to urge said first finger away from said second finger.

14. A garment hanger comprising an elongated hanger body having first and second opposing ends, a first arm coupled to said first end of said hanger body and a second arm coupled to said second end of said hanger body, a first essentially semi-circular plastic web integrally joining said first arm to said first end of said garment hanger body and a second essentially semi-circular web integrally joining said second arm to said second end of said garment hanger body, said first and second webs exerting torque on said first and second arms tending to urge said arms apart as said arms are manually moved towards one another, said first and second arms including outer surfaces, an upwardly extending first finger on the outer surface of said first arm and an upwardly extending second finger on the outer surface of said second arm, said first and second fingers being respectively biasingly coupled to said respective arms, a third essentially semi-circular plastic web integrally joining said first finger to said first arm and a fourth essentially semi-circular plastic web integrally joining said second finger to said second arm, said third and fourth webs exerting torque on said first and second fingers tending to rotate said fingers outwardly.

15. The garment hanger as claimed in claim 14, wherein said first and second fingers include free ends, said free ends each including a hook formed thereon.

* * * * *

UNITED STATES PATENT AND TRADEMARK OFFICE

CERTIFICATE OF CORRECTION

PATENT NO. : 5,346,110
DATED : September 13, 1994
INVENTOR(S) : Nicoleon Petrou and David Petrou It is certified that error appears in the above-indentified patent and that said Letters Patent is hereby corrected as shown below:

In item [76] Inventors, on the cover page of the patent add "David Petrou, 2728 Benvenue Avenue, Apt. 3, Berkeley, California 94705", as a second named inventor.

Signed and Sealed this

Third Day of January, 1995

*Attest:*

Bruce Lehman

BRUCE LEHMAN

*Attesting Officer*

*Commissioner of Patents and Trademarks*